US005541359A

United States Patent [19]

Lee

[11] Patent Number: 5,541,359

[45] Date of Patent: Jul. 30, 1996

[54] AUDIO SIGNAL RECORD FORMAT APPLICABLE TO MEMORY CHIPS AND THE REPRODUCING METHOD AND APPARATUS THEREFOR

[75] Inventor: Young-man Lee, Suwon, Rep. of Korea

[73] Assignee: Samsung Electronics Co., Ltd., Kyungki-Do, Rep. of Korea

[21] Appl. No.: 202,483

[22] Filed: Feb. 28, 1994

[30] Foreign Application Priority Data

Feb. 26, 1993 [KR] Rep. of Korea ..... 93-2710

[51] Int. Cl.[6] ..... G10H 7/00

[52] U.S. Cl. ..... 84/645; 84/610; 84/634

[58] Field of Search ..... 84/610, 634, 645

[56] References Cited

U.S. PATENT DOCUMENTS

| | | | |
|---|---|---|---|
| 4,942,551 | 7/1990 | Klappert et al. . | |
| 5,054,360 | 10/1991 | Lisle et al. | 84/645 |
| 5,056,145 | 10/1991 | Yamamoto et al. | 381/51 |
| 5,056,402 | 10/1991 | Hikawa et al. | 84/645 |
| 5,062,097 | 10/1991 | Kumaoka | 84/645 X |
| 5,121,667 | 6/1992 | Emery et al. | 84/603 |
| 5,138,925 | 8/1992 | Koguchi et al. | 84/609 |
| 5,300,725 | 4/1994 | Manabe | 84/609 |

*Primary Examiner*—William M. Shoop, Jr.
*Assistant Examiner*—Jeffrey W. Donels
*Attorney, Agent, or Firm*—Sughrue, Mion, Zinn, Macpeak & Seas

[57] ABSTRACT

An audio signal record format includes a first region for recording an audio signal having an accompaniment signal recorded in accordance with musical instrument digital interface (MIDI) format and having a first determination bit, and for recording a digitized vocal signal including a second determination bit, and a second region for recording index information with respect to the recorded audio signal. The first and second determination bits permit separation of the accompaniment and vocal signals during simultaneous read-out thereof so as to facilitate production of analog signals and decoding, respectively. The record format is compatible with integrated circuit memories. A method employing the record format and a corresponding player are also described.

13 Claims, 5 Drawing Sheets

| | D8 | D7 ~ D0 |
|---|---|---|
| 10H | 1 | ① 'S ACCOMPANIMENT DATA |
| | 0 | ① 'S VOCAL DATA |
| | 1 | ② 'S ACCOMPANIMENT DATA |
| | 0 | ② 'S VOCAL DATA |
| | ≈ | ≈ |
| | 1 | ⑥ 'S ACCOMPANIMENT DATA |
| | 0 | ⑥ 'S VOCAL DATA |
| | 1 | ⑦ 'S ACCOMPANIMENT DATA |
| | 0 | ⑦ 'S VOCAL DATA |

FIG. 4A
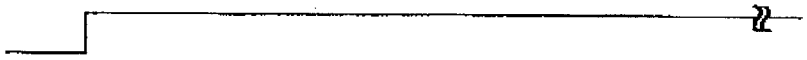
FIG. 4B
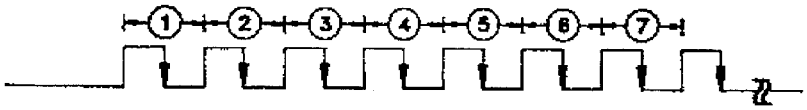
FIG. 4C
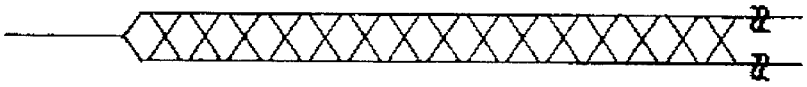
FIG. 4D
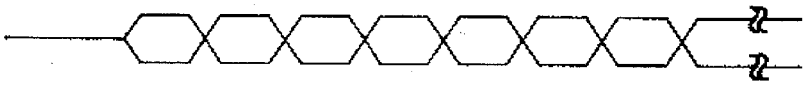
FIG. 4E
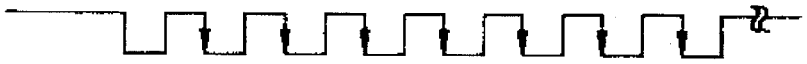
FIG. 4F
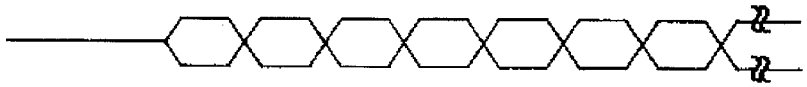
FIG. 5A
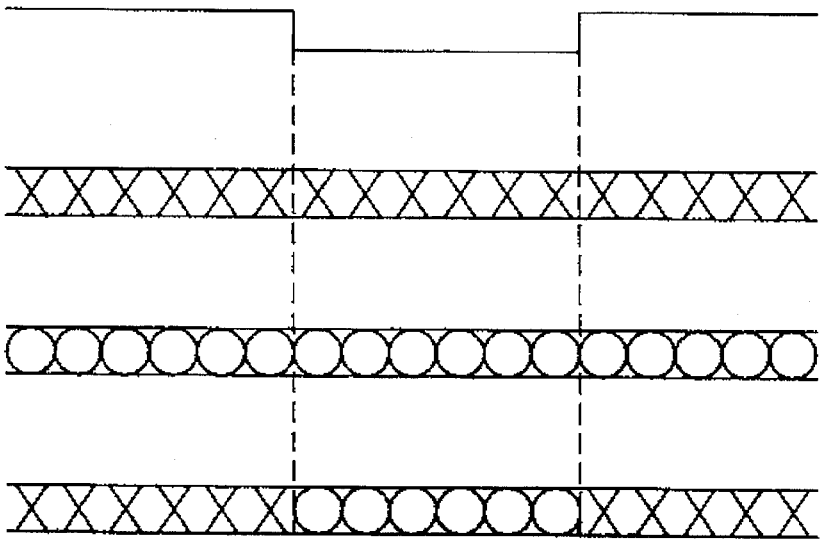
FIG. 5B
FIG. 5C
FIG. 5D

AUDIO SIGNAL RECORD FORMAT APPLICABLE TO MEMORY CHIPS AND THE REPRODUCING METHOD AND APPARATUS THEREFOR

BACKGROUND OF THE INVENTION

1. Field of the Invention

The present invention relates to an audio signal record format and the reproducing method and apparatus therefor, wherein a memory chip is used as the recording medium.

2. Discussion of Related Art

In an audio signal processing apparatus such as an optical disk player for recording/reproducing an optical disk (e.g., compact disk) or a cassette player for recording/reproducing magnetic tape (e.g., a digital audio tape or a cassette tape), a memory device is used to reproducing an the audio signal instead of a reproducing circuit (e.g., a deck or pickup device) for magnetic tape or disk, which is usually associated with the conventional recording medium.

Thus far, the limited capacity and high cost of semiconductor memory have presented barriers to the recording of an audio signal in the memory as, e.g., pulse code modulated data. Therefore, to record the audio signal in the memory, the data requires compression for reducing the volume of the coded audio signal. Alternatively, the accompaniment signal and vocal signal, which together make up the audio signal, should be recorded separately in different channels.

That is, the data quantity of accompaniment signal can be significantly reduced using a musical instrument digital interface (MIDI) format. Digitizing only the vocal signal requires a lower amount of data than the data sampling associated with a compact disk. Therefore, large amounts of audio signals can be recorded and/or reproduced using a limited memory capacity.

One multichannel musical instrument/computer system is disclosed in U.S. Pat. No. 5,121,667, wherein a memory of large capacity is connected to a plurality of random access memories, and the respective random access memories are connected to an oscillator bank producing a musical sound from a plurality of sound sources. In the above system, the MIDI device is connected to the musical instrument or system for reproducing and/or recording the musical sound.

An improved digital sound recording apparatus, which shows higher portability, reliability and utility for learning language and music, is disclosed in U.S. Pat. No. 5,056,145. In this apparatus a case and an IC card which can be attached to the case, are provided. Digitized vocal data is recorded in the first memory region of the IC card, and an identification code corresponding to the start address of the vocal data is recorded in the second memory region. A reproducing unit included in the case converts the digitized vocal data recorded in the memory into an analog signal which is then output during the language lesson.

SUMMARY OF THE INVENTION

It is an object of the present invention to provide an audio signal record format whereby an accompaniment signal recorded by the MIDI format and a digitized vocal signal are separately recorded in a memory, and whereby a determination signal for determining the two signals is appended to either of the two recorded signals.

It is another object of the present invention to provide an audio signal record format whereby the accompaniment signal recorded by a sound source integrated circuit (IC) format and the digitized vocal signal are separately recorded in the memory, and whereby a determination signal for determining the two recorded signals is appended to either of the two recorded signals.

It is still another object of the present invention to provide an audio signal reproducing method for mixing the accompaniment signal and vocal signal recorded in the memory and reproducing the mixed signal, or for mixing accompaniment signal with external audio signal instead of vocal signal and reproducing the mixed signal.

It is a further object of the present invention to provide an audio signal reproducing apparatus which is most suitable to the realization of the audio signal reproducing method.

It is yet another object of the present invention to provide a musical instrument apparatus for reproducing the accompaniment and vocal signals from the memory where the accompaniment and vocal signals are separately recorded and determination signals for determining the two signals are recorded, and the method therefor.

These and other objects, features and advantages according to the present invention are provided by an audio signal record format including a first region for recording audio signal comprised of an accompaniment signal recorded by a format of a musical instrument digital interface, the accompaniment signal having a determination bit, and a digitized vocal signal having a determination bit, and a second region for recording index information corresponding to the recorded audio signal.

These and other objects, features and advantages according to the present invention are provided by a method for reproducing the audio signal in the case of the audio signal recording/reproducing apparatus using an audio signal record format which comprises a first region for recording audio signal including an accompaniment signal recorded by a musical instrument digital interface format, the accompaniment signal having a determination bit, and a digitized vocal signal having a determination bit, and a second region for recording index information on the recorded audio signal, the method comprising the steps of:

(a) reading out and reproducing the accompaniment signal of the audio signal from the memory according to the determination bit;

(b) reading out and reproducing the vocal signal of the audio signal from the memory according to the determination bit; and (c) mixing the output signal of the accompaniment signal reproducing step with the output signal of the vocal signal reproducing step to thereby provide a mixed signal.

These and other objects, features and advantages according to the present invention are provided by an audio signal reproducing apparatus including:

a memory including a first memory region for recording an audio signal comprised of an accompaniment signal recorded in musical instrument digital interface format, the accompaniment signal having a determination bit, and a digitized vocal signal having a determination bit, and a second memory region for recording index information on the recorded audio signal;

an accompaniment signal reproducing circuit for reading out and reproducing the accompaniment signal from the audio signal recorded on the memory according to the determination bit;

a vocal signal reproducing circuit for reading out and reproducing the vocal signal from the audio signal recorded on the memory according to the determination bit;

a system controller controlling the data output from the memory to be selectively transmitted to the accompaniment signal reproducing circuit or the vocal signal reproducing circuit by recognizing the determination bit, and controlling the overall operation of the system by recognizing the input function keys; and a mixer for mixing the output signal of the accompaniment signal reproducing circuit with the output signal of the vocal signal reproducing circuit to thereby output the mixed signal.

BRIEF DESCRIPTION OF THE DRAWINGS

The above object and advantages of the present invention will become more apparent by describing in detail a preferred embodiment of the present invention with reference to the attached drawings in which:

FIGS. 4A through 4F show the waveforms present at the respective portions of the audio signal reproducing apparatus shown in FIG. 1;

FIGS. 5A through 5D show the waveforms present at the respective portions of the audio signal reproducing apparatus shown in FIG. 1, when an external audio signal is selected.

DETAILED DESCRIPTION OF PREFERRED EMBODIMENTS

Figure 1:
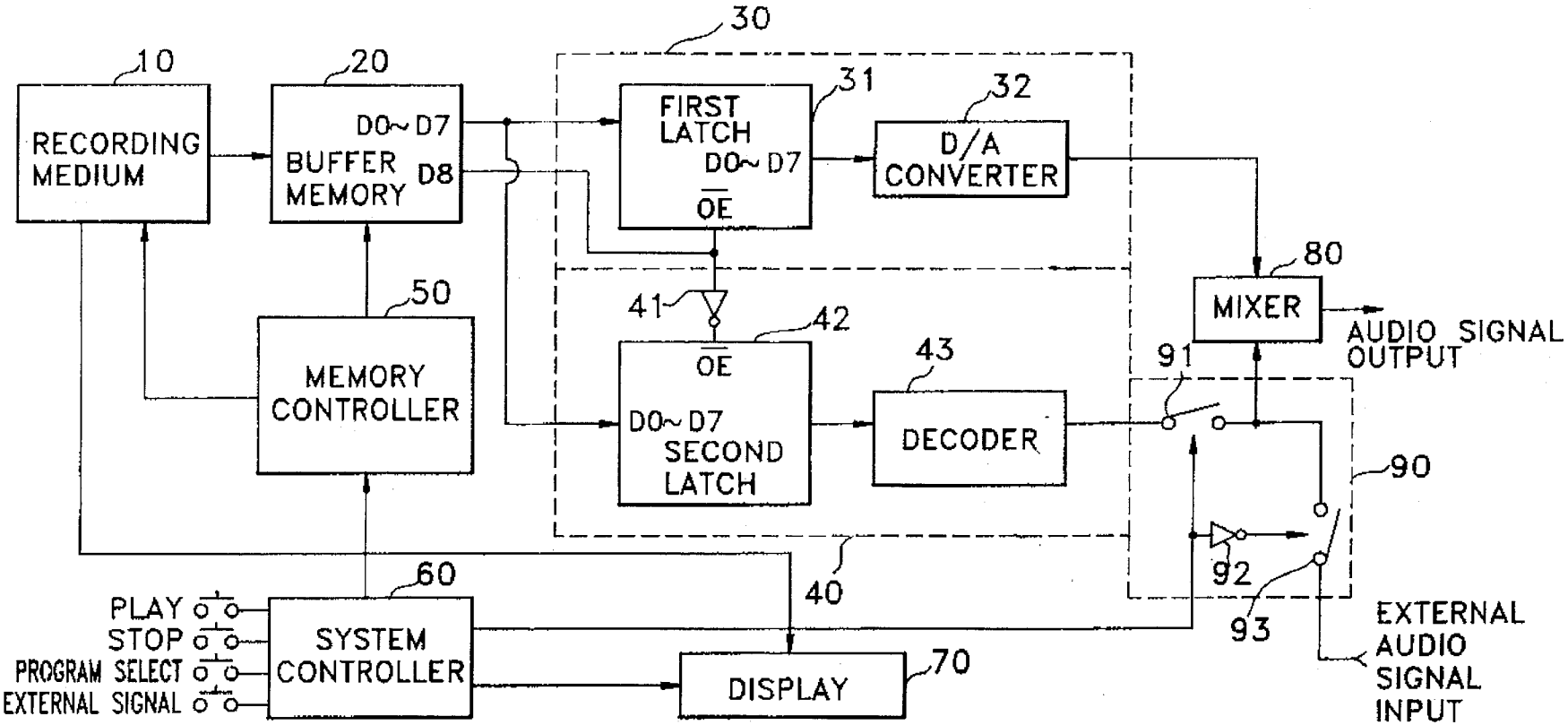
FIG. 1 is a block diagram of an audio signal reproducing apparatus according to an embodiment of the present invention.

FIG. 1 is a block diagram showing an audio signal reproducing apparatus according to an embodiment of the present invention.

Referring to FIG. 1, the audio signal reproducing apparatus includes a recording medium 10, which preferably is an integrated circuit for separately recording an accompaniment signal recorded using the MIDI format, and a digitized vocal signal, and for separately recording at predetermined locations the determination signals for identifying the accompaniment and digital vocal signals. A buffer memory 20 receiving an audio signal from recording medium 10 temporarily stores the received signal and an accompaniment signal reproducing circuit 30 reads out and reproduces the accompaniment signal of the audio signal from buffer memory 20 with the aid of the above-mentioned determination signal. A vocal signal reproducing circuit 40 reads out and reproduces the vocal signal of the audio signal from buffer memory 20 with the aid of the determination signal. A memory controller 50 produces a read-enable signal and read-address so that the audio signal with determination bit can be read out from recording medium 10, and produces a write-enable signal and write-address so that the read-out audio signal with determination bit is written in buffer memory 20. Preferably, a system controller 60 controls the entire system so that any function corresponding to a function key operated by a user can be executed. A display 70 displays the index information recorded in recording medium 10 under the control of system controller 60. A selector 90 for selectively outputting the vocal signal transmitted from vocal signal reproducing circuit 40 or the external audio signal input from an external source, under the control of system controller 60, is provided. A mixer 80 is also provided for mixing the accompaniment signal output from accompaniment signal reproducing circuit 30 with an external audio signal or the vocal signal output from vocal signal reproducing circuit 40 to thereby produce a mixed signal.

Preferably, accompaniment signal reproducing circuit 30 includes a first latch 31 for reading out and temporarily storing the accompaniment signal of the audio signal transmitted from buffer memory 20 according to the determination signal applied at an enable port $\overline{OE}$, and a digital-to-analog (D/A) converter 32 for converting the digital accompaniment signal output from first latch 31 into analog signal form.

Vocal signal reproducing circuit 40 includes a second latch 42 for reading out and temporarily storing the vocal signal of the audio signal from buffer memory 20 according to the determination signal applied at an enable port $\overline{OE}$, a first inverter 41 for inverting the logic state of the determination signal output from buffer memory 20 to thereby apply the determination signal having an inverted logic state at enable node $\overline{OE}$, and a decoder 43 for decoding the vocal signal output from second latch 42 to thereby reconstruct the original analog vocal signal.

Selector 90 includes a first switch 91, which advantageously turns on and off depending on the control signal produced from system controller 60 in accordance with the operation of an external key, so as to pass or block the vocal signal output from vocal signal reproducing circuit 40 to mixer 80. A second inverter 92 for inverting the control signal output from system controller 60, and a second switch 93, which opens or closes depending on the signal output from second inverter 92, so as to pass or block an external audio signal from being applied to mixer 80 are also provided.

Figure 2:
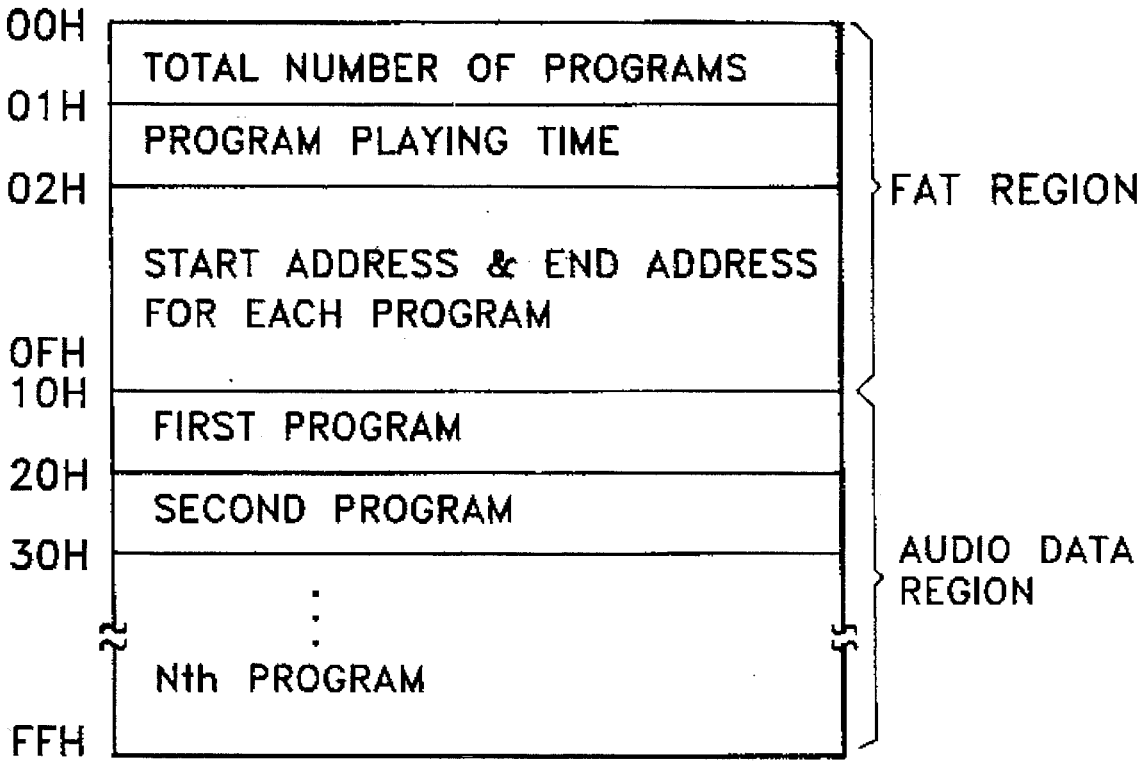
FIG. 2 is a high level conceptual diagram which is useful in understanding the composition of an integrated circuit used as a recording medium of the audio signal reproducing apparatus shown in FIG. 1.

FIG. 2 shows the composition of a memory (preferably, the above-mentioned integrated circuit of this embodiment) used as recording medium 10 shown in FIG. 1. The memory is divided into a file allocation table (FAT) region and audio data region. Here, the FAT region contains the information on the total number of programs recorded in recording medium 10, the playback time for each, and the start and end addresses for each.

Advantageously, the audio data region, includes the first program recorded from start address 10H to end address 1FH, and the second program recorded from start address 20H to end address 2FH. The vocal and accompaniment signals can be recorded in the audio data region, based on the MIDI format.

Figures 3A, 3B:
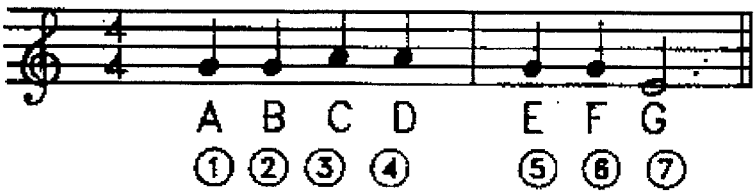
FIG. 3A shows a sample of musical notation for better understanding of the present invention.
FIG. 3B shows a data composition of the recording medium where the musical notation of FIG. 3A is recorded.

FIGS. 3A and 3B show the data composition with respect to a program according to an embodiment of the present invention. FIG. 3A is a musical notation showing the vocal signals/A/,/B/,/C/,/D/,/E/,/F/and/G/and the accompaniment signals, i.e., musical notes/g/,/g/,/a/,/a/,/g/,/g/and/e/.

FIG. 3B illustrates the vocal and accompaniment signals assigned to different addresses, when the vocal signal is digitized and recorded in recording medium 10. Here, bits D0–D7 correspond to vocal signal or accompaniment signal, and bit D8 corresponds to the determination signal (bit) for distinguishing the vocal signal from the accompaniment signal.

In this embodiment, logic state "1" of the determination signal indicates the accompaniment signal, while logic state "0" indicates the vocal signal. The accompaniment signal is recorded according to the MIDI format, considering the musical interval, sound duration, strength and tone, while the vocal signal is pulse-code-modulated to thereby be recorded as digital data.

FIGS. 4A through 4F show waveforms present at respective portions of the audio signal reproducing apparatus shown in FIG. 1. FIG. 4A shows the start signal occurring at system controller 60 when the play key is operated, FIG. 4B shows the determination signal output from buffer memory 20, FIG. 4C shows the mixed signal of the vocal and accompaniment signals, which are read-out from recording medium 10, FIG. 4D shows the accompaniment signal produced from first latch 31 according to the determination signal shown in FIG. 4B, FIG. 4E shows the inverted signal of the determination signal output from buffer memory 20, and FIG. 4F shows a vocal signal produced from second latch 42 according to the determination signal shown in FIG. 4E.

FIGS. 5A through 5D illustrate the waveforms present at respective portions of the audio signal reproducing apparatus shown in FIG. 1, for an exemplary case wherein an external audio signal is being selected. FIG. 5A shows the control signal occurring at system controller 60 when a key for setting the external audio signal is operated, FIG. 5B shows a vocal signal output from decoder 43, FIG. 5C shows the external audio signal, and FIG. 5D shows the mixed signal occurring at selector 90, the signal being a combination of the external audio signal and vocal signal which is output from decoder 43 (here, the external audio signal is an analog signal).

Figure 6:
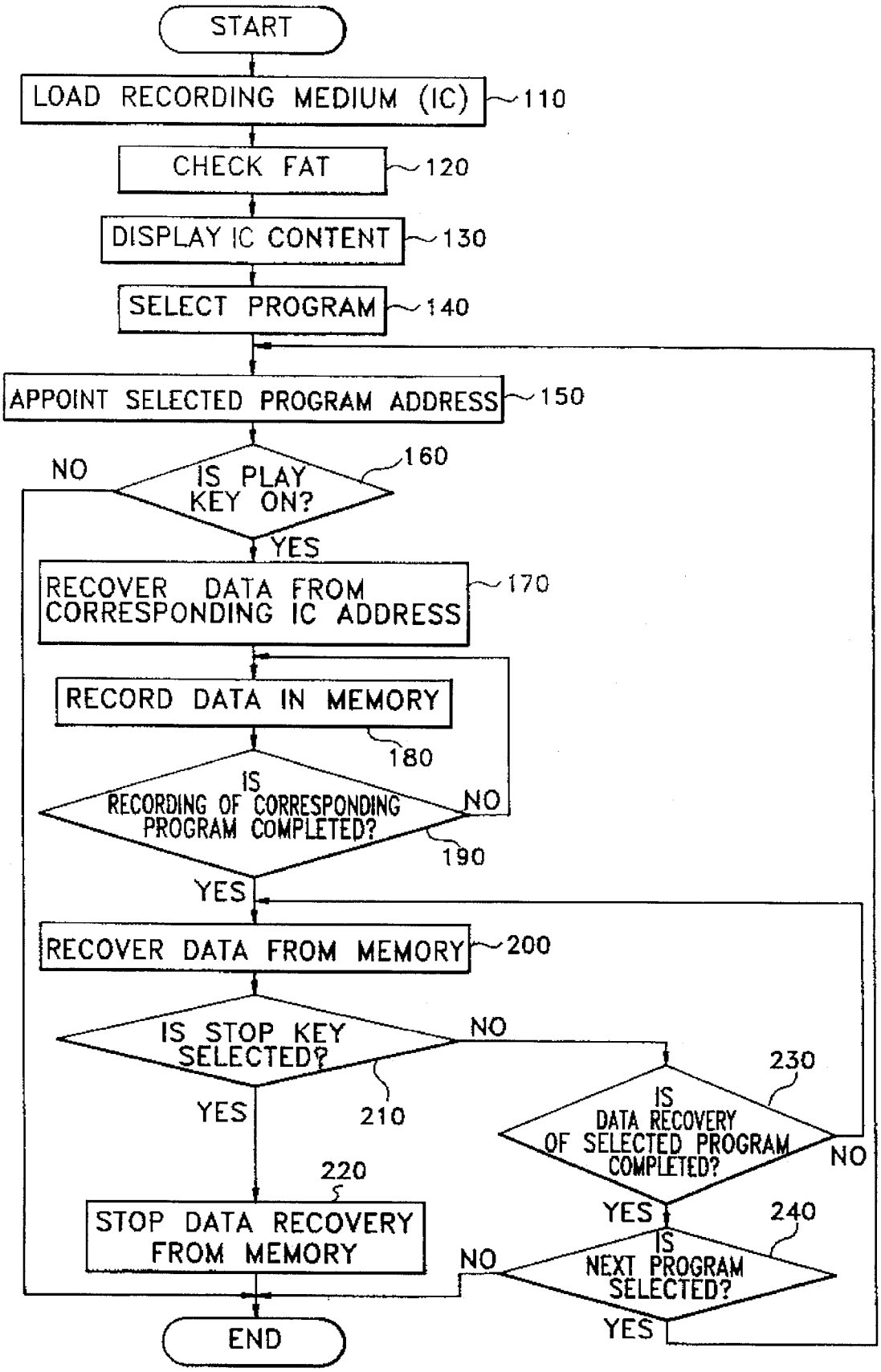
FIG. 6 is a flowchart illustrating the audio signal reproducing method according to an embodiment of the present invention.

FIG. 6 shows a flowchart illustrating a method for reproducing the audio signal according to the present invention. Here, step 110 is an initializing step for loading the recording medium 10 (i.e., the integrated circuit) into the apparatus, steps 120 through 150 are for displaying on display 70 the information recorded in the loaded recording medium 10, for allowing the user to select a program, steps 160 through 200 are for reading out the data recorded in the address (corresponding to the selected program) location of the recording medium in the case of the play key being operated, for storing the data in buffer memory 20 and for reproducing the data, steps 210 and 220 are for stopping the reading of the data from buffer memory 20 when the stop key is applied, and thereby finishing the reproduction operation, step 230 is for determining whether the reproduction of the selected program is finished, and step 240 is for selecting the next program.

Next, the operation of the reproducing apparatus according to one embodiment of the present invention will be described in more detail with reference to FIG. 1 and FIGS. 3 through 6.

A recording medium (integrated circuit memory) 10 is loaded during step 110 and system controller 60 checks the FAT of the information recorded in recording medium 10 during step 120, so as to display the information on display 70 in step 130. When the user selects a program with reference to the displayed FAT information (i.e., the index information) during step 140, an address corresponding to the selected program is set during step 150.

When system controller 60 detects that the play key is selected at step 160, the audio signal recorded at the address of recording medium 10 is read out, wherein the address corresponds to the selected program at step 170, and consequently, the read-out audio signal is recorded in buffer memory 20 during step 180. It should be noted that reading-out of the audio signal from recording medium 10 and recording of the audio signal in buffer memory 20 are advantageously controlled by memory controller 50.

The audio signal recorded in buffer memory 20 is read out again by the read signal from memory controller 50, so that the read-out audio signal enters accompaniment signal reproducing circuit 30 and vocal signal reproducing circuit 40. That is, after a program is selected, if system controller 60 detects that the play key is operated, system controller 60 applies the start signal (FIG. 4A) at memory controller 50, so that the audio signal can be read out from recording medium 10 and written into buffer memory 20.

When the recording of the entire audio signal of the corresponding program is finished being written into buffer memory 20 at step 190, the audio signal is read out and reproduced from buffer memory 20 during step 200. If the stop key is selected during step 21 0, the reading of audio signal from buffer memory 20 is interrupted at step 220. If the stop key is not selected, it is determined whether the playing of a program is completed (step 230). If the playing of a program is completed, it is determined whether the next program is selected at step 240, and if so, a loopback operation to step 150 for setting an address of the corresponding program is performed. When the next program is not selected, the data recovery using buffer memory 20 is interrupted.

Since the audio signal recorded on recording medium 10 is composed of the accompaniment signal corresponding to the sound generated by the accompanying music and the vocal signal corresponding to a user's voice, the audio signal is separated into two signals, to be input to accompaniment signal reproducing circuit 30 and vocal signal reproducing circuit 40, respectively.

That is, in accompaniment signal reproducing circuit 30, the accompaniment signal is latched by first latch 31 according to the determination signal (D8 bit set to "1" and shown in FIGS. 3B and 4B) applied at enable port $\overline{OE}$ (FIG. 4D), so that the accompaniment signal is converted into an analog signal by D/A converter 32 to reproduce the accompaniment signal having the desired musical interval, sound duration, strength, and musical instrument tone.

In vocal signal reproducing circuit 40, the vocal signal is latched by second latch 42 according to the determination signal (D8 bit set to "0" and shown in FIGS. 3B and 4E) applied at enable port $\overline{OE}$ (FIG. 4F), so that decoder 43 reconstructs the original analog vocal signal.

Mixer 80 mixes the accompaniment signal from accompaniment signal reproducing circuit 30 with the vocal signal from vocal signal reproducing circuit 40, so that the original analog audio signal is produced.

If the user wishes to mix an arbitrary audio signal, e.g., his voice or an external vocal signal, with the accompaniment signal without reference to the original vocal signal, system controller 60 detects that the external audio signal input key is selected, and thereby produces the corresponding control signal (FIG. 5A). Selector 90 supplies mixer 80 with the external audio signal (FIG. 5C) instead of vocal signal (FIG. 5B) for the predetermined duration in response to the control signal.

The present invention can be utilized for a musical accompaniment apparatus, such as karaoke systems or laser disc players, for extended and useful applications.

As described above, the audio signal record format and the reproducing method and apparatus therefor according to the present invention not only records/reproduces the vocal and accompaniment signals without the use of another instrument, but also mixes the accompaniment signal with an external audio signal instead of the conventionally applied vocal signal.

Other modifications and variations to the invention will be apparent to those skilled in the art from the foregoing disclosure and teachings. Thus, while only certain embodiments of the invention have been specifically described herein, it will be apparent that numerous modifications may be made thereto without departing from the spirit and scope of the invention.

What is claimed is:

1. An audio signal record format for recording an audio signal in a memory to thereby produce a recorded audio signal, said format comprising:

a first region for recording an audio signal comprising:

an accompaniment signal recorded according to a musical instrument digital interface (MIDI) format, said accompaniment signal identified by a first determination bit; and a digitized vocal signal identified by a second determination bit; and a second region for recording index information on said recorded audio signal.

2. The audio signal record format as claimed in claim 1, wherein said memory is an integrated circuit including said first and said second regions.

3. A method for reproducing the audio signal in an audio signal recording/reproducing apparatus using an audio signal record format consisting of a first region for recording an audio signal including an accompaniment signal recorded in accordance with a musical instrument digital interface (MIDI) format, said accompaniment signal identified by a first determination bit, and a digitized vocal signal identified by a second determination bit, and a second region for recording index information on said recorded audio signal, said method comprising the steps of:

(a) reading out and reproducing the accompaniment signal of said audio signal from said memory according to a read-out determination bit among said first and second determination bits to thereby output reproduced accompaniment signal;

(b) reading out and reproducing the vocal signal of said audio signal from said memory according to said read-out determination bit to thereby output a reproduced vocal signal; and (c) mixing the output reproduced accompaniment signal of said step (a) with the output signal of said step (b).

4. The method for reproducing the audio signal as claimed in claim 3, further comprising the step of:

(d) receiving an external audio signal; and wherein said step (c) comprises mixing the output reproduced accompaniment signal with one of a selectively output said external audio signal and said reproduced vocal signal.

5. A method for reproducing an audio signal in an audio signal recording/reproducing apparatus using an audio signal record format including of a first region for recording an audio signal composed of an accompaniment signal recorded in accordance with a musical instrument digital interface (MIDI) format, said accompaniment signal including a first determination bit, and a digitized vocal signal including a second determination bit, and a second region for recording index information on the recorded said audio signal, said method comprising the steps of:

(a) loading said recording medium into the audio signal recording/reproducing apparatus;

(b) selecting a desired program among programs recorded on said recording medium;

(c) reading out and reproducing the audio signal corresponding to the desired program selected in said step (b), when a play key is operated;

(d) determining whether said reading out and reproducing step is completed;

(e) selecting another desired program when said step (d) is completed and then returning to said step (c); and (f) interrupting the reproducing operation if a stop key is operated during said step (c).

6. The method for reproducing the audio signal as claimed in claim 5, wherein said step (a) further comprises the steps of:

(g) reading out the index information recorded in said memory;

(h) displaying said index information;

(i) selecting a desired program among programs displayed on index information; and (j) reading program selection information corresponding to said desired program.

7. An audio signal reproducing apparatus comprising:

a memory including a first memory region for recording audio signal comprised of an accompaniment signal recorded in accordance with a musical instrument digital interface (MIDI) format, said accompaniment signal having a first determination bit, and a digitized vocal signal having a second determination bit, and a second memory region for recording index information on a recorded said audio signal;

an accompaniment signal reproducing circuit for reading out and reproducing the accompaniment signal from said audio signal recorded on said memory according to the read-out determination bit among said first and second determination bits;

a vocal signal reproducing circuit for reading out and reproducing the vocal signal from said audio signal recorded on said memory according to said, read-out determination bit;

a system controller for controlling the data being output from said memory to be selectively transmitted to one of said accompaniment signal reproducing circuit and said vocal signal reproducing circuit by recognizing said determination bit, and for controlling the overall operation of the system by recognizing function key inputs; and mixer for mixing an output accompaniment signal of said accompaniment signal reproducing circuit with the output vocal signal of said vocal signal reproducing circuit.

8. The audio signal reproducing apparatus as claimed in claim 7, further comprising a display for displaying the index information recorded in said memory, under the control of said system controller.

9. The audio signal reproducing apparatus as claimed in claim 8, further comprising:

a buffer memory for receiving the accompaniment signal and the vocal signal of a selected program from said memory, and for storing said signals therein; and a memory controller for controlling the data read-out from said memory to be stored in said buffer memory, under the control of said system controller.

10. The audio signal reproducing apparatus as claimed in claim 9, wherein said accompaniment signal reproducing circuit comprises:

a latch receiving said determination bit as an enable signal, for temporarily storing the accompaniment signal of the audio signal recovered from said buffer memory; and a digital-to-analog convertor for converting said accompaniment signal output from said first latch means into analog signal form.

11. The audio signal reproducing apparatus as claimed in claim 9, wherein said vocal signal reproducing circuit comprises:

a latch receiving said determination bit as an enable signal, for reading out the vocal signal from the audio signal read out from said buffer memory, and temporarily storing therein said vocal signal; and a decoder for decoding the vocal signal output from said second latch means, to thereby reconstruct the original analog vocal signal.

12. The audio signal reproducing apparatus as claimed in claim 7, further comprising:

an external input terminal for receiving the external audio signal; and a selector for selectively sending one of the vocal signal output from said vocal signal reproducing circuit and the external audio signal input through said external input terminal to said mixer, under the control of said system controller.

13. The audio signal reproducing apparatus as claimed in claim 7, wherein said memory is an integrated circuit.

* * * * *